US005772030A

United States Patent [19]

Baxter

[11] Patent Number: 5,772,030

[45] Date of Patent: Jun. 30, 1998

[54] CARTON FOR PACKAGING TWO TIERS OF ARTICLES

[75] Inventor: Ronald A. Baxter, Douglasville, Ga.

[73] Assignee: The Mead Corporation, Dayton, Ohio

[21] Appl. No.: 823,401

[22] Filed: Mar. 24, 1997

[51] Int. Cl.[6] ..... B65D 71/00

[52] U.S. Cl. ..... 206/427

[58] Field of Search ..... 206/427, 428, 206/429, 430, 434, 139, 193, 194

[56] References Cited

U.S. PATENT DOCUMENTS

| | | | |
|---|---|---|---|
| 4,049,189 | 9/1977 | Wood | 206/427 |
| 4,685,566 | 8/1987 | Wilson | 206/427 |
| 5,307,932 | 5/1994 | Stout et al. | 206/141 |
| 5,320,277 | 6/1994 | Stout et al. | 229/117.13 |
| 5,427,242 | 6/1995 | Oliff et al. | 206/430 |
| 5,482,203 | 1/1996 | Stout | 229/117.13 |
| 5,558,224 | 9/1996 | Fogle | 206/427 |

FOREIGN PATENT DOCUMENTS

| | | |
|---|---|---|
| 2 619 081 | 2/1989 | France . |
| WO 96/29260 | 9/1996 | WIPO . |
| WO 96/29261 | 9/1996 | WIPO . |

*Primary Examiner*—Jacob K. Ackun
*Attorney, Agent, or Firm*—Thomas A. Boshinksi

[57] ABSTRACT

A package for containers such as cans or bottles arranged into two tiers includes a carton having a top wall, a pair of side walls, and a bottom wall all interconnected to form a tubular structure. A pair of lower end flaps is connected to the end edges of the bottom wall and a pair of upper end flaps is connected to the end edges of the top wall, the flaps being glued together to close the carton ends. The side wall width is smaller than the top or bottom wall length, whereby the carton includes open corners through which a portion of some of the packaged articles are exposed. A divider panel includes a main body portion having a pair of end edges and is of a length generally equal to said top wall length. A pair of divider end flaps are connected to the end edges of the main body. The divider panel is disposed within the carton. Each of the divider end flaps is glued to an inner surface of one of the upper and lower end flaps.

1 Claim, 5 Drawing Sheets

CARTON FOR PACKAGING TWO TIERS OF ARTICLES

BACKGROUND OF THE INVENTION

The present invention relates generally to paperboard cartons for use in packaging articles. It is particularly useful for cartons for packaging containers such as cans or bottles for beverages, although the invention is not limited in this regard. More particularly, the invention relates to such a carton in which the articles are stacked in two tiers.

Containers such as cans or bottles for beverages including soft drink, beer, juices and the like are commonly sold in multiple quantities packaged in a paperboard carton. Recently, there has been introduced into the marketplace beverage cartons wherein cans are arranged in two tiers, with corresponding cans from each tier being axially aligned. A paperboard divider panel is placed between the two tiers. An example of such a carton can be seen by reference to U.S. Pat. No. 5,427,242. Such cartons are usually intended to hold relatively large numbers of cans, for example 24 to 36 cans.

Such cartons are relatively large, and therefore require a large amount of paperboard for their manufacture. Moreover, their large size often results in an inefficient layout of carton blanks on the paperboard web from which they are cut. To make such cartons more economical, various measures have been developed to reduce the amount of paperboard they require.

An example of one technique may be seen in the above-referenced U.S. Pat. No. 5,427,242. The divider panel is provided with end flaps which are folded downwardly along the endmost portion of the lower article group. These flaps can then be glued to the interior surf ace of the carton's end closure structure. The added stability which this gives enables the minor closure flaps of the carton to be made shorter than normal, thereby producing a savings of paperboard material.

In U.S. Pat. No. 5,482,203, a carton is provided with a handle reinforcing structure which is especially designed to reduce blank length. This objective is met by connecting handle reinforcing panels to the carton end flaps, rather than to the main carton panels.

Despite the teachings of such patents, two-tier cartons are still relatively expensive to manufacture. Thus, a need continues to exist for further reduction in the paperboard required for their manufacture. This could be accomplished either by reducing the amount of board contained within the carton blank, or by improving the nesting pattern (i.e., blank layout) of carton blanks on the web, or a combination of both.

SUMMARY OF THE INVENTION

In accordance with one embodiment, the present invention provides a package for containers such as cans or bottles arranged into two tiers. The package includes a carton having a top wall having opposed side edges and opposed end edges and defining a top wall length between the end edges, and a pair of side walls, one of the side walls being connected to each side edge of the top wall, each of the side walls defining a side wall width. A bottom wall is connected between the side walls to complete a tubular structure, the bottom wall having a pair of end edges and defining a bottom wall length substantially equal to the top wall length. A pair of lower end flaps is connected to the end edges of the bottom wall and a pair of upper end flaps is connected to the end edges of the top wall, the upper and lower end flaps being glued together to close the ends of the carton. The side wall width is smaller than said top wall length, whereby the carton includes open corners through which a portion of some of the packaged articles are exposed.

A divider panel includes a main body portion having a pair of end edges and defining a main body length generally equal to the top wall length. A pair of divider end flaps is connected to the end edges of the main body portion.

The divider panel is disposed within the carton and has each of the divider end flaps glued to an inner surface of one of the upper and lower end flaps.

DETAILED DESCRIPTION OF THE PREFERRED EMBODIMENT

Figure 1:
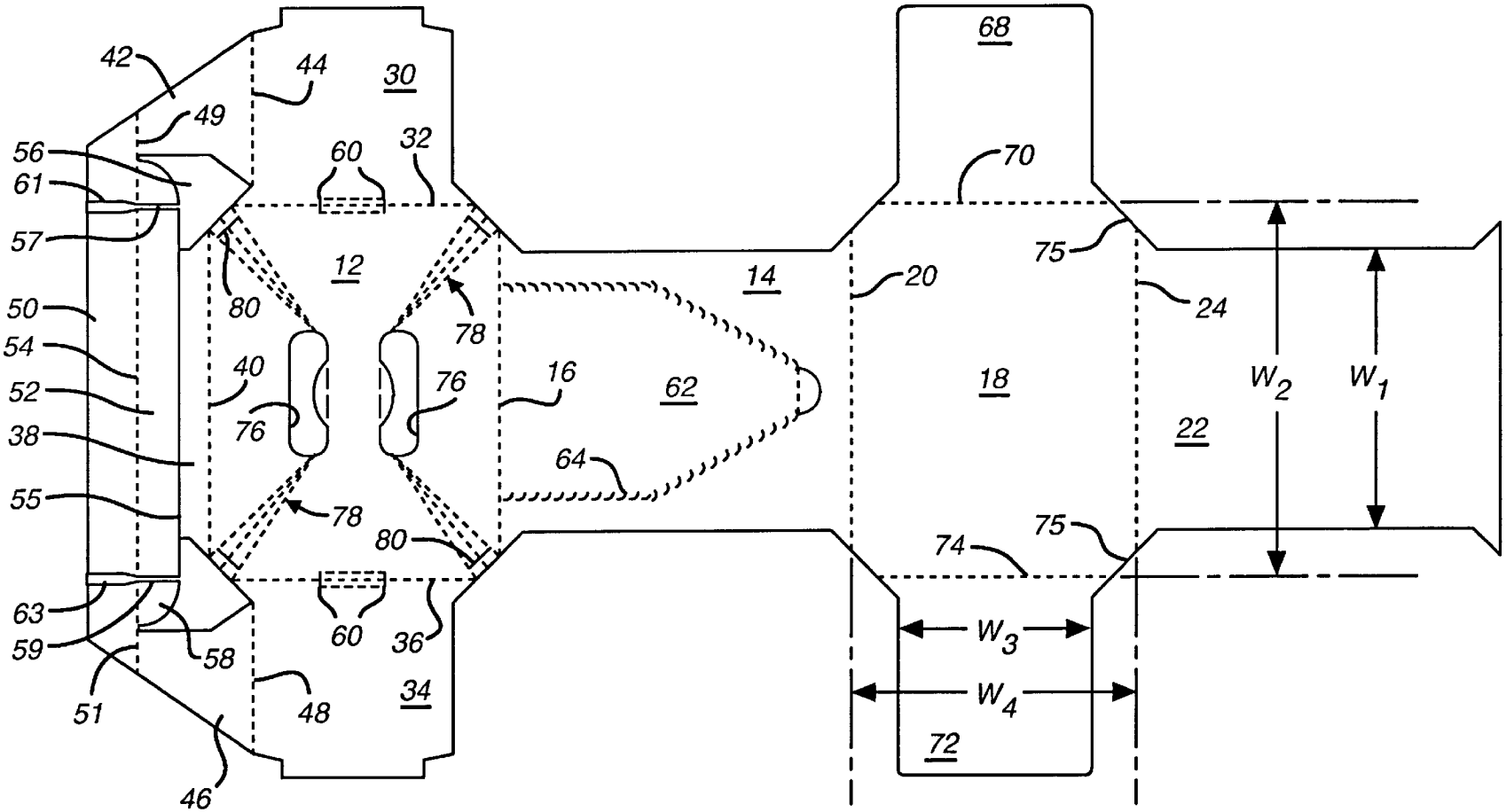
FIG. 1 is a plan view of the inner surface of a blank for forming a carton in accordance with the present invention.

A carton 10 for use in connection with the present invention may be seen in blank form by reference to FIG. 1, in which the inner surface of the blank is shown. In the drawings referred to herein, dashed lines represent fold lines within paperboard material, while solid lines represent cut lines in the paperboard, unless noted to the contrary.

The carton includes a top wall panel 12 connected to a side wall panel 14 along fold line 16. A bottom wall panel 18 is connected to side wall panel 14 along fold line 20, and at its opposite side is connected to side wall panel 22 along fold line 24.

A major end flap 30 is connected at one end edge of top wall panel 12 along fold line 32, while a second major end panel 34 is connected at the opposite end of top wall panel 12 along fold line 36. A glue flap 38 is connected to top wall panel 12 along fold line 40.

A handle reinforcing structure is connected to each of major end flaps 30 and 34, and comprises end portion 42 connected to major end flap 30 along fold line 44, and end portion 46 connected to major end flap 34 along fold line 48. A reinforcing strip 50 interconnects end portions 42 and 46 by fold lines 49 and 51 respectively. An auxiliary handle reinforcing strip 52 is connected to central portion 50 along a fold line 54. Reinforcing strip 52 is positioned adjacent to glue flap 38, separated therefrom along a cut line 55.

Auxiliary reinforcing strip 52 includes end flap 56 which extends towards end portion 42, and end flap 58 which extends towards end portion 46.

End flaps 56 and 58 are connected to the central portion of auxiliary reinforcing strip 52 along fold lines 57 and 59 which are debossed so as to protrude inwardly of the erected carton. Similar inwardly debossed lines, although having a wider debossed area, are formed across reinforcing strip 50. These debossed areas mate with an area along respective ones of fold lines 32 and 36 which are encased by torque relief slits 60 to thereby reduce tension along the outer surfaces of the fold lines between top wall panel 12 and major end flaps 30 and 34. Further details regarding this structure may be found by reference to U.S. Pat. No. 5,320,277, which is incorporated herein by reference.

Side wall panel 14 includes a removable access panel 62 defined by a perforated tear line 64.

Bottom wall panel 18 has a major end flap 68 connected along fold line 70 at one end edge thereof, while a second major end flap 72 is connected at an opposite end edge along fold line 74.

Finally, side wall panel 22 includes a minor end flap 76 connected at one end edge along fold line 78, and a minor end flap 80 connected along fold line 82 at the opposite end edge.

It can be seen that neither side wall panel 14 or 22 has end flaps connected thereto as is typical in end-loaded cartons. Moreover, each side wall panel incudes a width $W_1$ which is less than the distance $W_2$ between notional lines defined by extensions of the fold lines 70 and 74 (or lines 32 and 36). In other words, the width of the side walls is less than the length of top wall panel 12 or bottom wall panel 18.

It can also be seen that the end flaps 30 and 34, and end flaps 68 and 72, are narrower than the width of the corresponding top and bottom wall panels 12 and 18. The flap width $W_3$ is thus less than the distance $W_4$ between notional lines defined by extensions of the fold lines 20 and 24 (or lines 16 and 40).

It can further be seen that side wall panel 22 and end flap 68 are not disposed immediately adjacent each other despite both being connected to bottom wall panel 18 along fold lines 24 and 70, respectively. Rather, a bevelled cut edge 75 is disposed at the corner of wall panel 18. Similar bevel edges are provided at the remaining corners of bottom wall panel 18 and at the corners of top wall panel 12.

Top wall panel 12 includes a pair of hand apertures 76 for forming a portion of a handle structure for the carton. Additionally, reinforcing fold lines 78 extend from apertures 76 toward the bevelled corner edges of top wall panel 12. Reinforcing lines 78 are preferably arranged in groups of diverging lines, preferably three such lines comprising each group. Extending across the plurality of lines 78 near each corner is a cut line 80. The fold lines 78 and cut edges 80 function to provide strengthening "tenting" effect to the top wall panel, thereby increasing handle strength for the carton. Further detail regarding the handle structure may be found by reference to the disclosure of U.S. Pat. No. 5,307,932.

In an alternative embodiment, the cut lines 80 may be eliminated, with the bevel corner edge itself serving the purpose of the cut line 80. Such an embodiment is described in the above-referenced U.S. Pat. No. 5,307,932. Other known handle arrangements could also be used.

Figure 6:
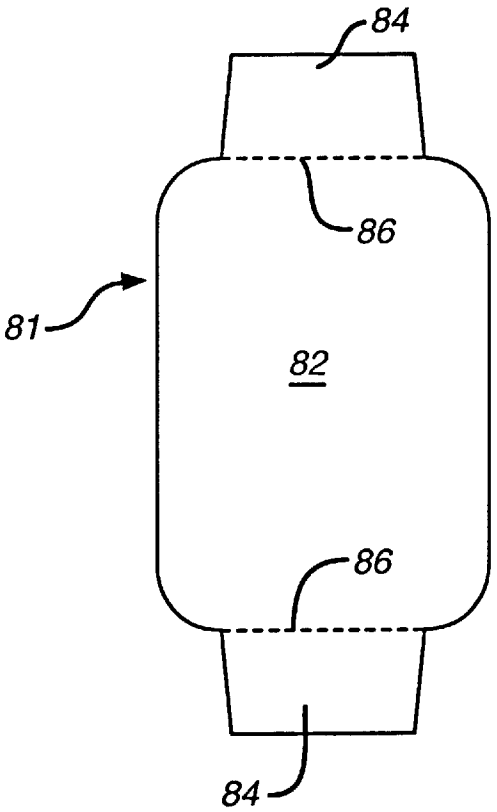
FIG. 6 is a plan view of a divider panel used in combination with the carton of the present invention.

Referring now to FIG. 6, a divider panel 81 used in combination with the carton 10 to form the package may be seen. The panel includes a main portion 82 to which end flaps 84 are connected along fold lines 86. Main portion 82 is of a shape and size which is substantially the same as the horizontal cross-section of the tier of articles to be packaged within the carton.

It will be recognized that the divider panel may be optionally provided with various further features, such as the finger apertures and fold lines disclosed in PCT Published Application WO96/29261, the stiffening channels disclosed in PCT Published Application WO96/29260, or the central tear line disclosed in U.S. Pat. No. 5,427,242.

Figure 3:
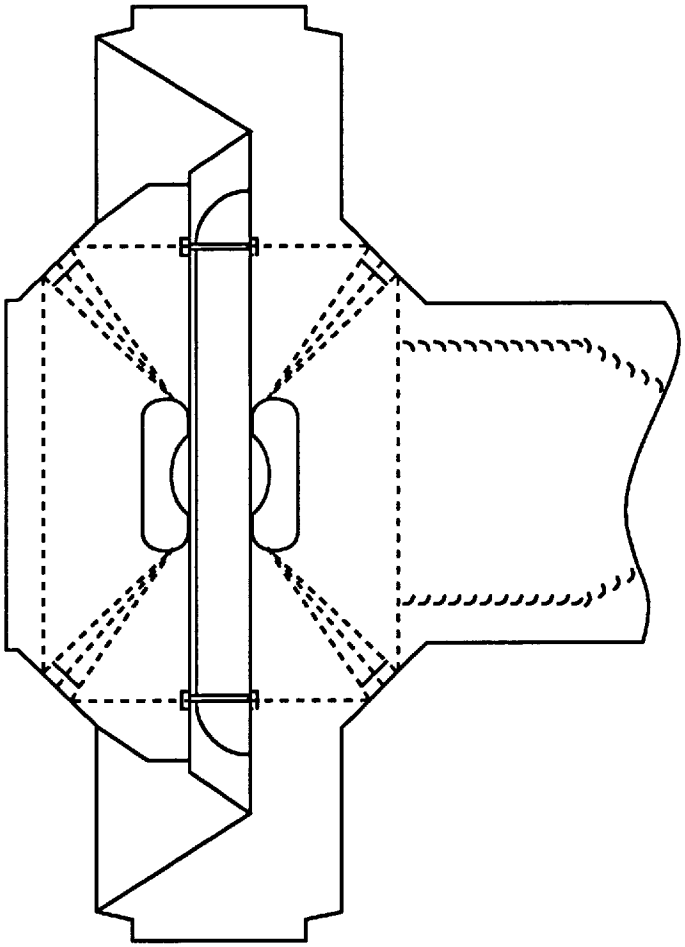
FIGS. 3, 4 and 5 are plan views of the blank of FIGS. 1 and 2, further illustrating the formation of the carton.
Figure 2:
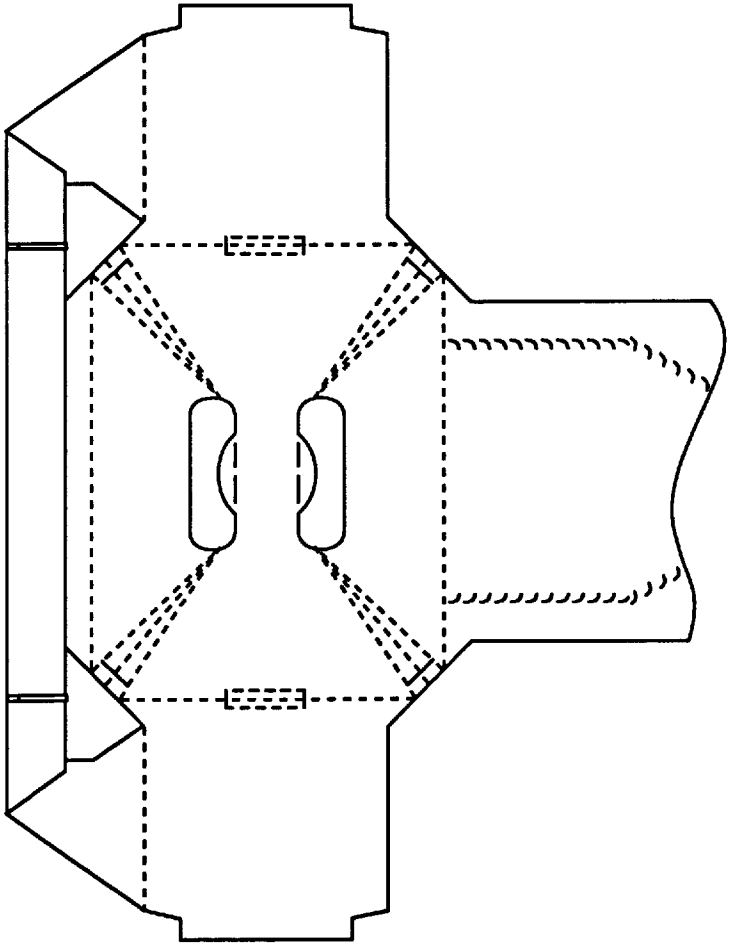
FIG. 2 is a partial plan view similar to FIG. 1, showing a first step in the formation of a carton from the blank of FIG. 1.

Referring now to FIG. 2, a portion of the blank for carton 10 can be seen, showing the beginning of the assembly process for the carton. The reinforcing strip is folded about fold lines 49, 51 and 54, and is glued to end portions 42 and 46 and auxiliary reinforcing strip 52. In FIG. 3, the handle reinforcing structure is folded along fold lines 44 and 48, and is glued to top wall panel 12 and major end panels 30 and 34. Reinforcing strip 50 is thus glued to top wall panel 12 so as to extend along the region between the finger apertures 76. Thus, a three-ply reinforced structure between the apertures is formed.

Figure 4:
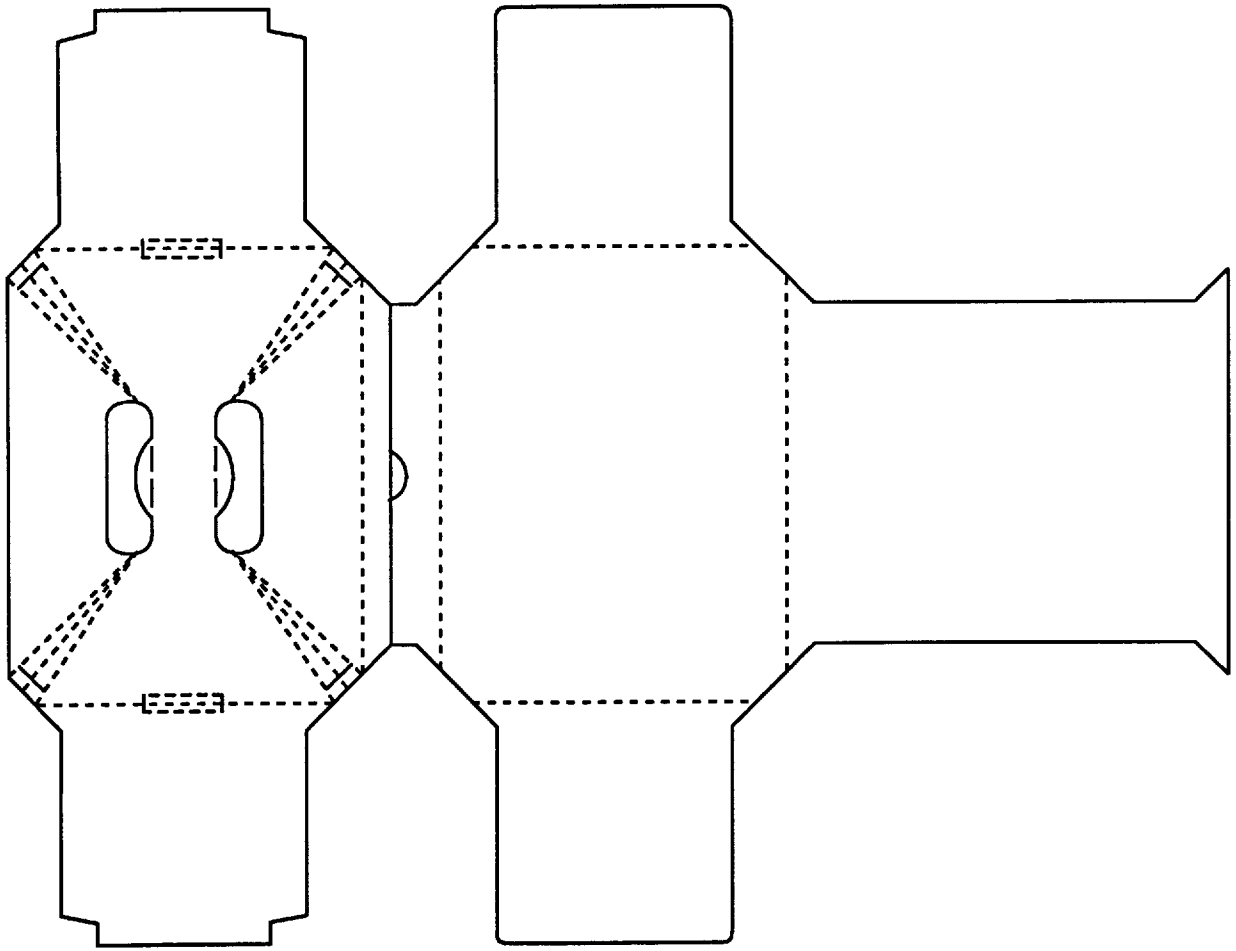
Figure 5:
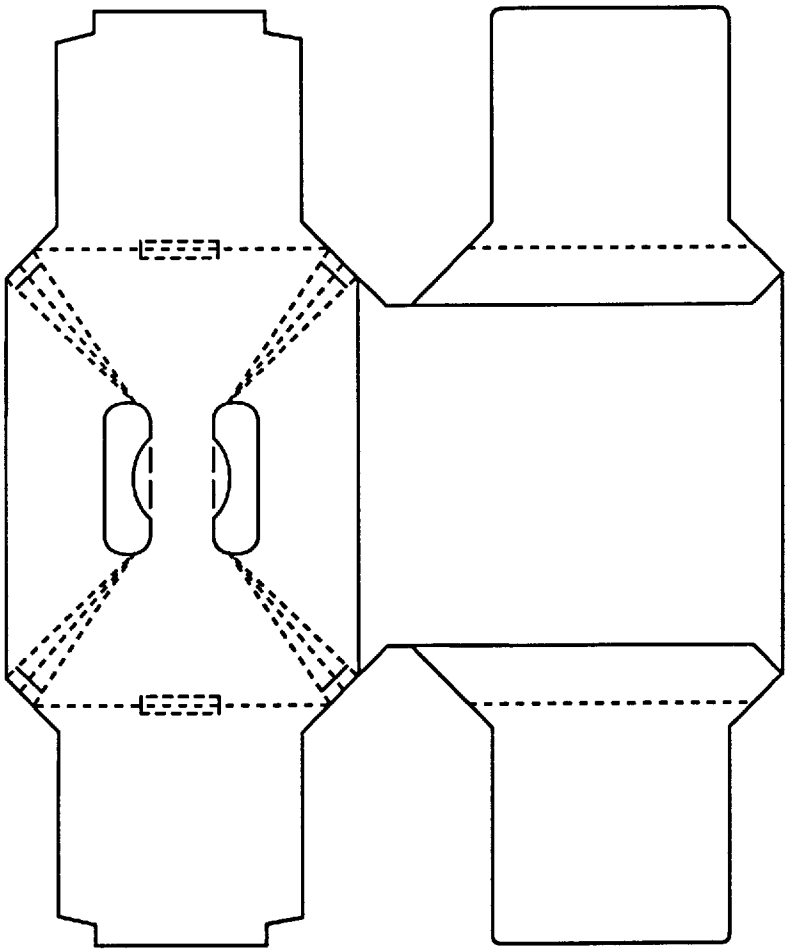

The remainder of the assembly of carton 10 can be seen by reference to FIGS. 4 and 5. In FIG. 4, the top wall panel 12 is shown folded along fold line 16 into overlapping arrangement with side wall panel 14. Glue is applied along glue flap 38 and, as shown in FIG. 4, side wall panel 22 is folded along fold line 24. The upper edge of side wall panel 22 is then adhered to glue flap 38 to complete the collapsed carton.

Figure 7:
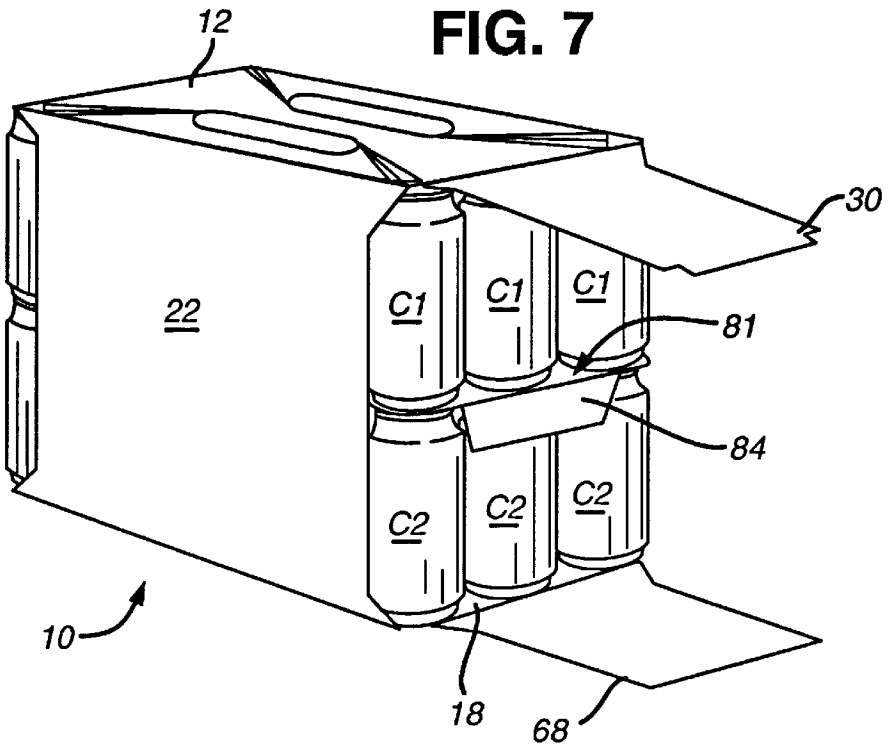
FIG. 7 is a three-quarter view of the top, side and end of an erected and loaded carton formed from the blank of FIG. 1, showing the end closure structure prior to folding and sealing.

The carton is loaded as shown in FIG. 7. First, the carton is erected into a tubular structure. The carton 10 is shown with its end closure structure, comprising only major end flaps 30 and 68, in an open position prior to the application of glue for sealing. The carton is loaded, as shown here for example, with beverage cans arranged into two tiers. A divider panel 81 as described herein is positioned between the tiers. Cans C1 of the upper tier are positioned on divider panel 81, which in turn rests upon the tops of the cans C2 of the lower tier. Cans C2 are in turn positioned on the bottom wall panel 18 of the carton 10. The can arrangement, as is conventional, is assembled prior to loading, and the stacked and arranged cans are loaded by pushing into the carton tube through one or both of its open ends. Such operation may be carried out by suitable, commercially-available automated packaging machinery.

Closure and sealing of the end closure structure is effected in the following manner. End flap 30 and flap 84 of divider panel 81 are folded downwardly, with glue applied to flap 84 and the lower portion of end flap 30. End flap 68 is then raised and adhered to flaps 30 and 84 by the applied glue.

A similar operation is carried out at the opposite end of the carton.

Figure 8:
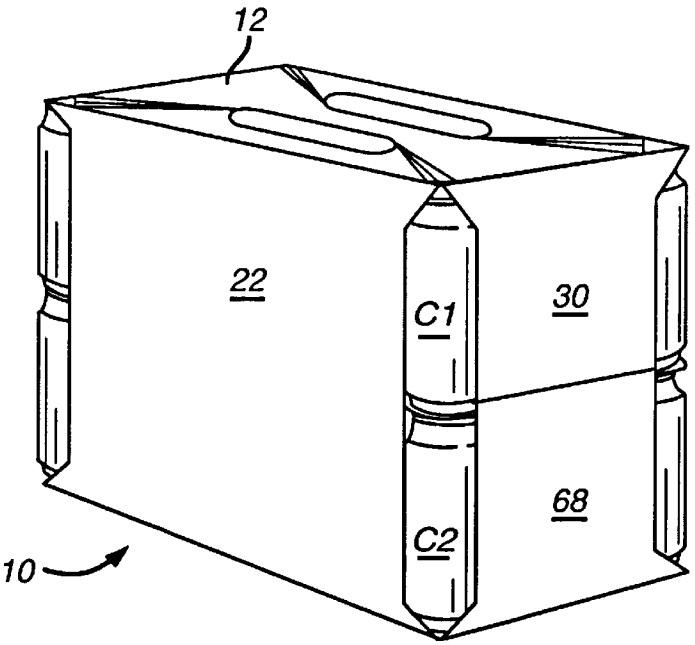
FIG. 8 is a view similar to FIG. 7, but showing the end closure structure sealed to form the finished carton.

The loaded and sealed carton may be seen by reference to FIG. 8. Because the divider panel is glued to the end flaps, the carton exhibits sufficient rigidity and resistance to "rock", even though the minor end flaps common in end-loaded cartons have been eliminated. Moreover, the provision of open corners, caused by the relatively narrow widths of side wall panels 14 and 22 and end flaps 30, 34, 68 and 72, significantly reduces the amount of paperboard utilized by the carton, and significantly improves blank layout and nesting on the paperboard web or sheet from which the carton is cut.

It will be recognized that as used herein, the directional references "top", "bottom", "end" and "side" do not limit the respective panels to such orientation, but merely serve to distinguish these panels one from another.

What is claimed is:

1. A package for containers such as cans or bottles arranged into two tiers, comprising:

a carton including a top wall having opposed side edges and opposed end edges and defining a top wall length between said end edges;

a pair of side walls, one of the side walls connected to each said side edge of said top wall, each of said side walls defining a side wall width;

a bottom wall connected between said side walls to complete a tubular structure, said bottom wall having a pair of end edges and defining a bottom wall length substantially equal to said top wall length;

a pair of lower end flaps connected to said end edges of said bottom wall and a pair of upper end flaps connected to said end edges of said top wall, said upper and lower end flaps being glued together to close the ends of said carton;

said side wall width being smaller than said top wall length, whereby said carton includes open corners through which a portion of some of the packaged articles are exposed; and a divider panel including a main body portion having a pair of end edges and defining a main body length generally equal to said top wall length;

a pair of divider end flaps connected to said end edges of said main body;

said divider panel being disposed within said carton and having each of said divider end flaps glued to an inner surface of one of said upper and lower end flaps.

* * * * *